US010890013B2

(12) United States Patent
Lai

(10) Patent No.: US 10,890,013 B2
(45) Date of Patent: Jan. 12, 2021

(54) CABLE LOCK WITH DUAL UNLOCKING MECHANISM

(71) Applicant: THE SUN LOCK COMPANY, LTD., Tuen Mun (HK)

(72) Inventor: Karl Lai, Tai Po (HK)

(73) Assignee: THE SUNLOCK COMPANY, LTD., Tuen Mun (HK)

( * ) Notice: Subject to any disclaimer, the term of this patent is extended or adjusted under 35 U.S.C. 154(b) by 319 days.

(21) Appl. No.: 16/132,799

(22) Filed: Sep. 17, 2018

(65) Prior Publication Data

US 2019/0153750 A1 May 23, 2019

Related U.S. Application Data

(60) Provisional application No. 62/589,887, filed on Nov. 22, 2017.

(51) Int. Cl.

| | |
|---|---|
| ***E05B 37/00*** | (2006.01) |
| ***E05B 37/02*** | (2006.01) |
| ***E05B 67/00*** | (2006.01) |
| ***E05B 35/10*** | (2006.01) |

(52) U.S. Cl.

CPC ..... *E05B 37/0034* (2013.01); *E05B 35/105* (2013.01); *E05B 37/025* (2013.01); *E05B 67/003* (2013.01)

(58) Field of Classification Search

CPC .... E05B 37/00; E05B 37/0034; E05B 37/025; E05B 35/105; E05B 67/003; E05B 17/14; E05B 67/24

USPC ..... 70/21–25, 284, 285

See application file for complete search history.

(56) References Cited

U.S. PATENT DOCUMENTS

| | | | | |
|---|---|---|---|---|
| 4,733,548 | A * | 3/1988 | Ling | E05B 37/025 70/25 |
| 7,155,943 | B1 * | 1/2007 | Lin | E05B 37/0031 70/21 |
| 10,047,541 | B2 * | 8/2018 | Lai | E05B 17/145 |
| 2005/0235705 | A1 | 10/2005 | Ling et al. | |
| 2006/0150690 | A1 * | 7/2006 | Lai | E05B 67/10 70/21 |
| 2006/0260369 | A1 * | 11/2006 | Lai | E05B 67/24 70/38 C |

(Continued)

FOREIGN PATENT DOCUMENTS

| | | |
|---|---|---|
| GB | 2539982 | 4/2017 |

*Primary Examiner* — Suzanne L Barrett

(74) *Attorney, Agent, or Firm* — Ware, Fressola, Maguire & Barber LLP

(57) ABSTRACT

A lock has a cable engageable with a lock body. The cable has two ends, each of which has a cable neck. The lock has a shaft operatively engaged with a stack of clutches and a plurality of dials. The shaft has a top portion with a shaft slot engageable with the cable neck on the first cable end. The first cable end can be released from the lock body with a combination mechanism. The lock has a fixed cam having a cam slot engageable with the cable neck of the second cable end. The lock further comprises a blocking plate slideably engaged with the fixed cam, and a rotatable cam configured to control the positions of the blocking plate. The rotatable cam is connected to a cylinder operable with a key to rotate the rotatable cam to release the second cable end from the fixed cam slot.

10 Claims, 13 Drawing Sheets

(56) References Cited

U.S. PATENT DOCUMENTS

| | | | | |
|---|---|---|---|---|
| 2008/0011025 | A1* | 1/2008 | Lin | E05B 37/0034 70/21 |
| 2008/0066500 | A1 | 3/2008 | Su | |
| 2013/0025333 | A1* | 1/2013 | Lai | E05B 37/0034 70/21 |
| 2013/0118215 | A1* | 5/2013 | Lai | E05B 37/0034 70/21 |
| 2015/0191940 | A1 | 7/2015 | Chen et al. | |
| 2017/0009488 | A1* | 1/2017 | Lai | E05B 37/0058 |
| 2017/0073999 | A1 | 3/2017 | Lai | |
| 2020/0011085 | A1* | 1/2020 | Lai | E05B 67/003 |

* cited by examiner

CABLE LOCK WITH DUAL UNLOCKING MECHANISM

CROSS REFERENCE TO RELATED PATENT APPLICATION

This application claims priority under 35 USC § 119 to U.S. Provisional Patent Application No. 62/589,887, filed Nov. 22, 2017, whose entire contents are hereby incorporated by reference.

TECHNICAL FIELD

The present invention relates to a lock and more specifically, to a cable lock that uses a cable as shackle.

BACKGROUND OF THE INVENTION

Most of the locks today are designed with an overriding key mechanism to allow a Transportation Security Administration (TSA) agent to open the lock with a special key for inspection purposes. There is a need to provide a cable lock wherein the cable can be released from the lock with a combination code or with a key overriding mechanism.

SUMMARY OF THE DISCLOSURE

The present invention provides a lock comprising a cable and a lock body. The body is arranged to receive a shaft on one side and a fixed cam on the other side. The cable has a first cable end and a second cable end, the shaft having a top portion removably engaged with the first cable end, and the fixed cam having a cam slot removably engaged with the second cable end. The first cable end can be released by a combination mechanism and the second cable end can be released by a key overriding mechanism. Thus, it is an aspect of the present invention to provide a lock operable in a locked mode and in an unlocked mode, comprising:

a lock body having a first end and an opposing end;

a stack of clutches;

a plurality of dials, each associated with a different one of the clutches;

a fixed cam having a fixed cam slot;

a shaft comprising a shaft body and a top portion adjacent to the first end of the lock body, the top portion having a shaft slot, the shaft further comprising a plurality of shaft protrusions on the shaft body, each shaft protrusion associated with one of the clutches, and a cable comprising a first cable end and a second cable end, the first cable end having a first end neck removably engaged with the shaft slot, the second cable end having a second end neck removably engaged with the fixed cam slot of the fixed cam, wherein the lock body comprises:

a plurality of dial slots dimensioned to receive the dials, and a body channel dimensioned to receive the stack of clutches and the shaft, and wherein each of the clutches has an extended fin on an outer surface of the clutch and an inner ring extended inward from an inner surface of the clutch, the inner ring having an opening gap made thereon, the opening gap dimensioned to receive the associated shaft protrusion, the inner ring having a lower surface and an upper surface facing the first end of the lock body, and wherein each of the dials has a plurality of teeth dimensioned to receive the extended fin of the associated clutch, wherein when the lock is operated in the locked mode, each of the shaft protrusions is located below the lower surface of the inner ring of the associated clutch, and the opening gap of at least one of the clutches is misaligned with the associated shaft protrusion, preventing the shaft from moving upward relative to the lock body, and when the lock is operated in the unlocked mode, the opening gap of each of the clutches is aligned with the associated shaft protrusion, allowing the shaft to move upward to release the first end neck of the first cable end from the lock body.

According to an embodiment of the present invention, the shaft further comprises a reset pointer, and the lock body further comprises a restricting track near the first end of the lock body, the restricting track dimensioned to receive the reset pointer, and wherein when the lock is operated in the locked mode, the reset pointer of the shaft is engaged with the restricting track, preventing the shaft from rotation relative to lock body, and when the lock is operated in the unlocked mode, the shaft is caused to move upward to disengage the reset pointer from the restricting track, allowing the shaft to rotate relative to the lock body to reset the lock.

According to an embodiment of the present invention, the upper surface of the inner ring of each of the clutches comprises a reset edge spaced from the opening gap in the inner ring, and the lock body further comprises a reset track near the first end of the lock body, spaced from the restricting tract, wherein when the shaft is rotated so that the reset pointer is aligned with the reset track, the shaft can be pushed downward until each of the shaft protrusions is located in the reset edge of the associated clutch to prevent the clutch from rotation relative to the lock body.

According to an embodiment of the present invention, when each of the shaft protrusions is located in the reset edge of the associated clutch and the shaft is caused to move further downward to disengage the extended fins of the clutches from the teeth of the dials, the dials can be rotated without the clutches to set a new combination code.

According to an embodiment of the present invention, the lock further comprises:

a fixed cam located near the first end of the lock body, the fixed cam having a fixed cam slot arranged to engage with the second end neck of the second cable end;

a blocking plate slideably engaged with the fixed cam, the blocking plate is locatable at a first plate position and a second plate position, wherein when the blocking plate is located at the first plate position, the blocking plate is arranged to prevent the second end neck of the second cable end from disengaging from the fixed cam slot, and when the blocking plate is located at second plate position, the second end neck of the second cable end can be disengaged from the fixed cam slot.

According to an embodiment of the present invention, the blocking plate comprising a pin, and the lock further comprises:

a rotatable cam comprising a semi-spiral slot dimensioned to receive the pin of the blocking plate, and wherein when the rotatable cam is caused to rotate relative to the lock body from a first cam position to a second cam position, the blocking plate is also caused to move from the first plate position to the second plate position.

According to an embodiment of the present invention, the lock further comprises a cylinder located near the second end of the lock body, the cylinder comprising a key slot arranged to receive a key to open the lock by turning the cylinder relative to the lock body, wherein the cylinder comprises one or more cylinder protrusions, and the rotatable cam comprises one or more cam holes dimensioned to receive said one or more cylinder protrusions, and when the cylinder turns, the rotatable cam is caused to rotate relative to the lock body from the first cam position to the second cam position.

According to an embodiment of the present invention, the lock further comprises an indicator located near the first end of the lock body, and a fork plate having a fork wall adjacent to the rotatable cam, the fork plate locatable at a first fork position and a second fork position, the indicator having an indicator top and an indicator body with an indicator neck, the fork plate further comprising a fork opening dimensioned to receive the indicator body, and a fork groove extended from the fork opening dimensioned to receive the indicator neck when the fork plate is located at the first fork position, wherein the rotatable cam further comprises a cam finger, and wherein when the rotatable cam is located at the first cam position, the cam finger is spaced from the fork wall and the fork plate is located at the first fork position, and when the rotatable cam is located at the second cam position, the cam finger is arranged to push the fork wall away from the rotatable cam to release the indicator neck from the fork groove, allowing the indicator top to move out of the first end of the lock body.

According to an embodiment of the present invention, the top portion of the shaft comprises a rectangular part, and the lock body further comprises a top opening dimensioned to receive the rectangular part, and wherein when the lock is operated in the locked mode, the rectangular part of the shaft is engaged with the top opening of the lock body, preventing the shaft from rotation relative to lock body, and when the lock is operated in the unlocked mode, the shaft is caused to move upward to disengage the rectangular part from the top opening of the top body, allowing the shaft to rotate relative to the lock body to reset the lock.

According to an embodiment of the present invention, the upper surface of the inner ring of each of the clutches comprises a reset edge spaced from the opening gap in the inner ring, and when the shaft is caused to rotate and the rectangular part of the shaft is again receivable in the top opening of the lock body, the shaft can be pushed downward until the shaft protrusion is located in the reset edge of the associated clutch, the shaft protrusions configured to prevent the clutch from rotation relative to the lock body.

According to an embodiment of the present invention, when each of the shaft protrusions is located in the reset edge of the associated clutch, and the shaft is caused to move further downward to disengage the extended fins of the clutches from the teeth of the dials, the dials can be rotated without the clutches to set a new combination code.

DETAILED DESCRIPTION OF THE INVENTION

Figure 1A:
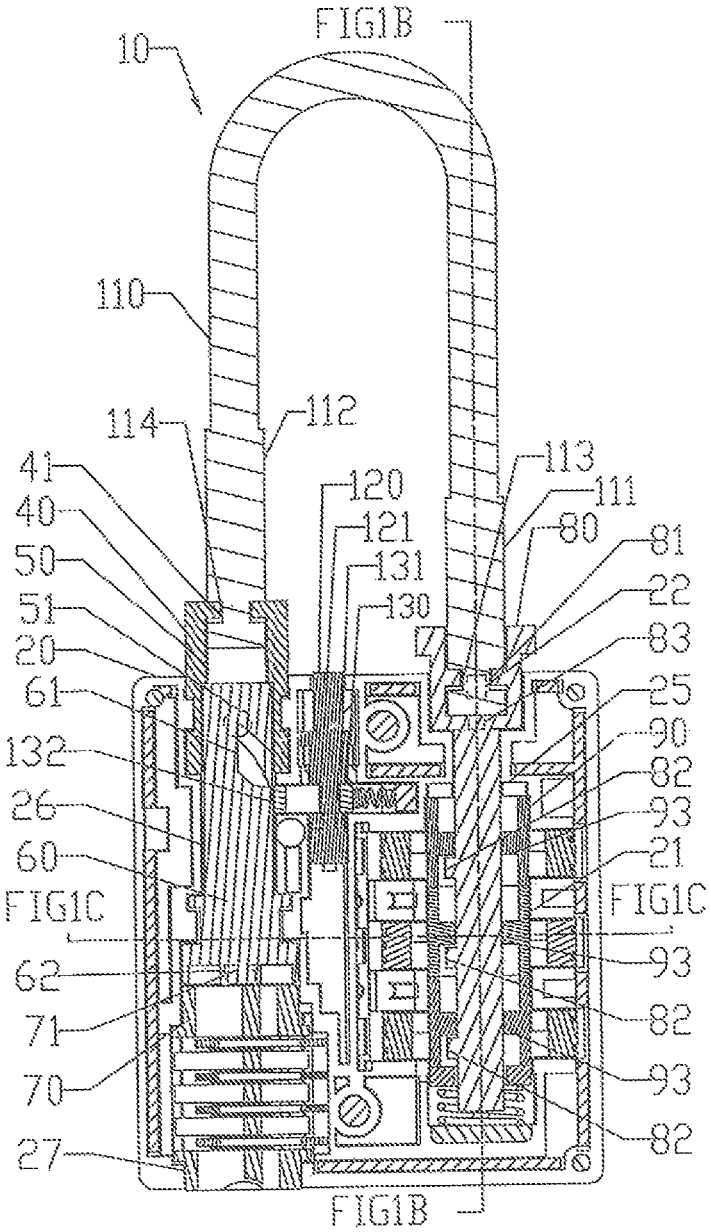
FIG. 1A is a cross-sectional front view of the cable lock when the lock is operated in the locked mode, according to an embodiment of the present invention.

The present invention provides a cable lock 10 operable in a locked mode and an unlocked mode. As seen in FIGS.

1A-20B, the lock 10 comprises a cable 110 and a lock body 20/30, the cable having a first cable end 111 and a second cable end 112, the lock body 20/30 arranged to receive a shaft 80 on one side of the lock body and a fixed cam 40 on the other side of the lock body. The shaft 80 has a top portion 85 removably engaged with the first cable end 111 and the fixed cam 40 has a cam slot 41 removably engaged with the second cable end 112. The first cable end 111 can be released by a combination mechanism and the second cable end 112 can be released by a key overriding mechanism. When the lock 10 is operated in the unlocked mode with the first cable end 111 released from the top portion 85 of the shaft 80, the lock 10 can be reset, allowing a user to set a new combination code.

Locked Mode (FIGS. 1A-13, 17A and 17B)

Figure 1B:
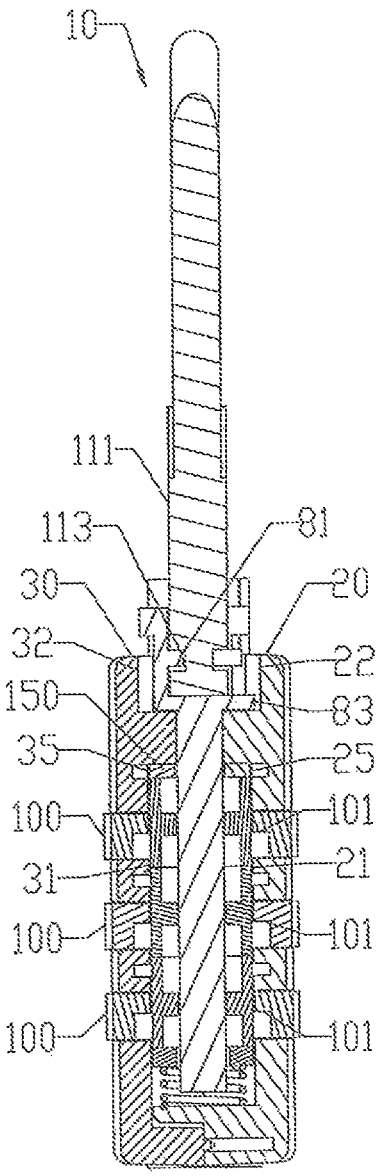
FIG. 1B is a cross-sectional side view of the cable lock of FIG. 1A.
Figure 1C:
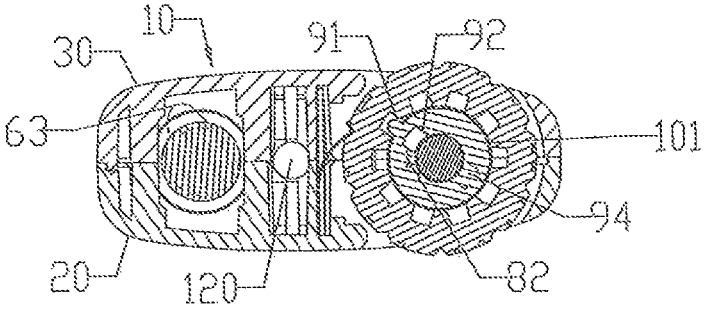
FIG. 1C is a cross-sectional bottom view of the cable lock of FIG. 1A.
Figure 2:
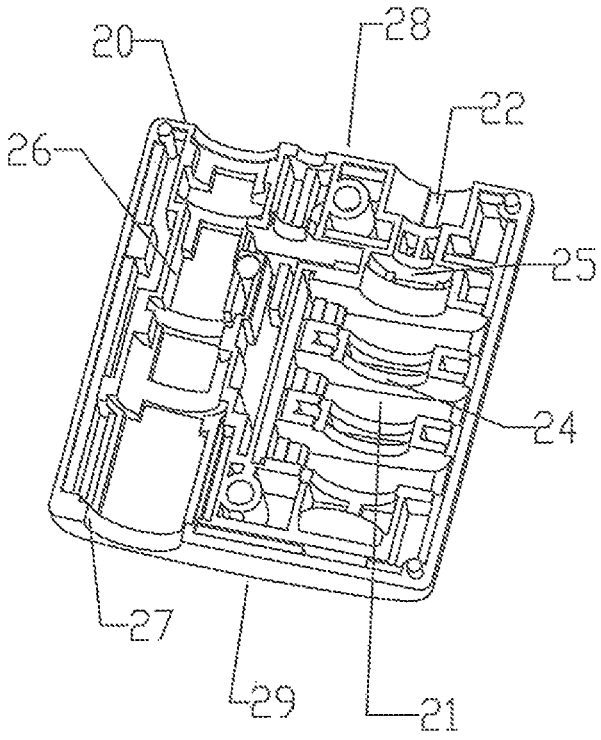
FIGS. 2 and 3 illustrate two halves of the lock body, according to an embodiment of the present invention.
Figure 3:
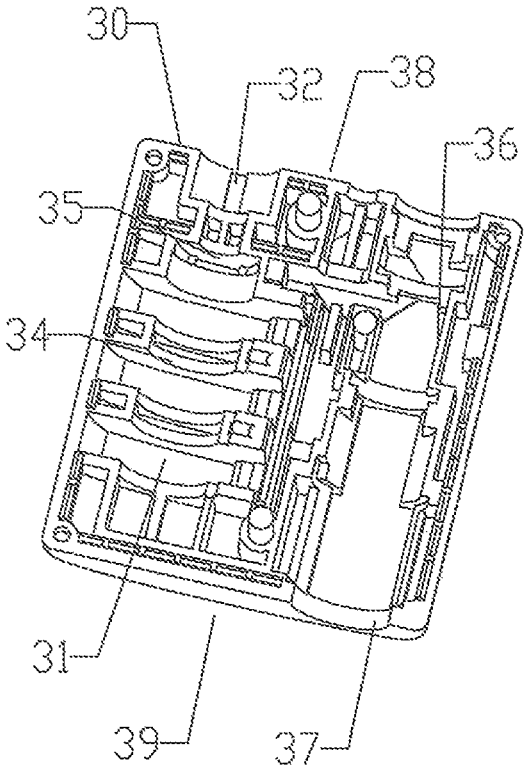
Figure 4:
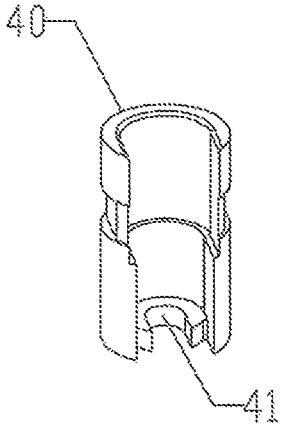
FIG. 4 illustrates a fixed cam, according to an embodiment of the present invention.
Figure 5:
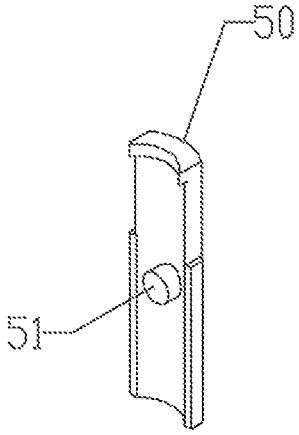
FIG. 5 illustrates a blocking plate, according to an embodiment of the present invention.
Figure 6:
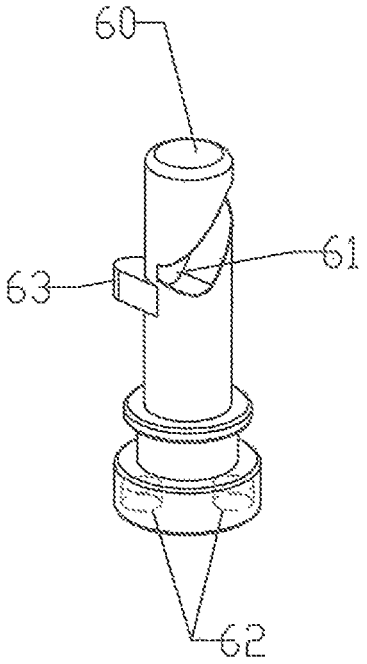
FIG. 6 illustrates a rotatable cam, according to an embodiment of the present invention.
Figure 7:
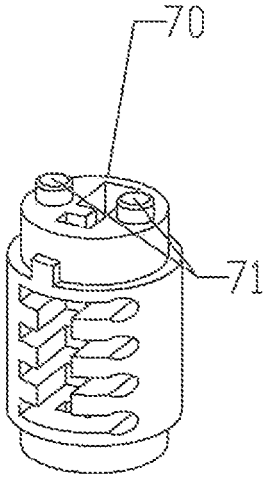
FIG. 7 illustrates a cylinder, according to an embodiment of the present invention.
Figure 8:
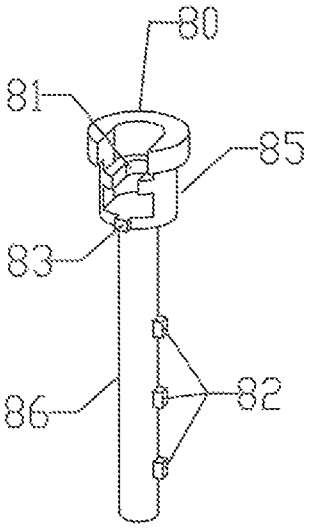
FIG. 8 illustrates a shaft, according to an embodiment of the present invention.
Figure 9A:
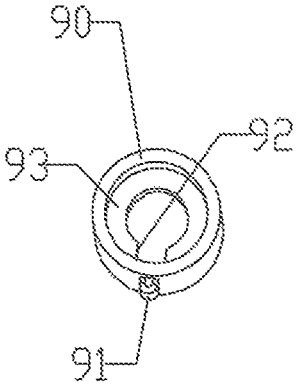
FIGS. 9A and 9B show the bottom view and the top view of a clutch, according to an embodiment of the present invention.
Figure 9B:
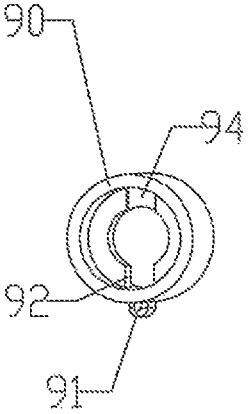
Figure 10:
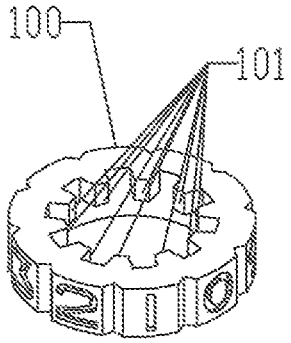
FIG. 10 illustrates a dial, according to an embodiment of the present invention.
Figure 11:
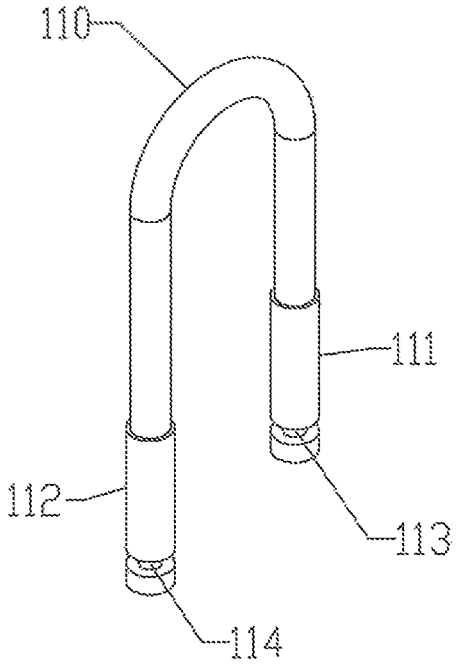
FIG. 11 illustrates a cable, according to an embodiment of the present invention.
Figure 12:
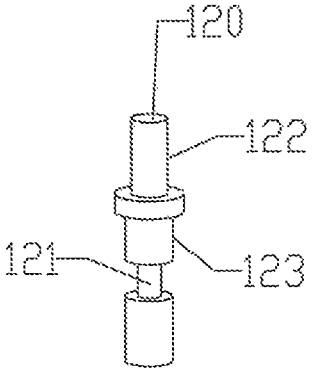
FIG. 12 illustrates an indicator, according to an embodiment of the present invention.
Figure 13:
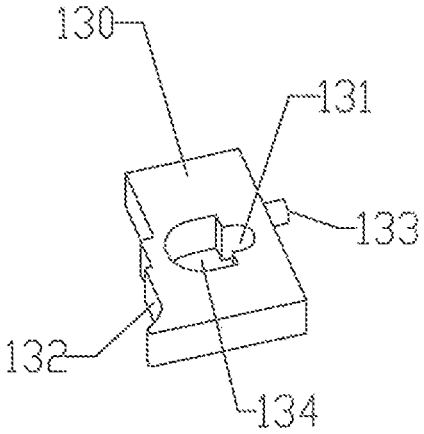
FIG. 13 illustrates a fork plate, according to an embodiment of the present invention.
Figure 14A:
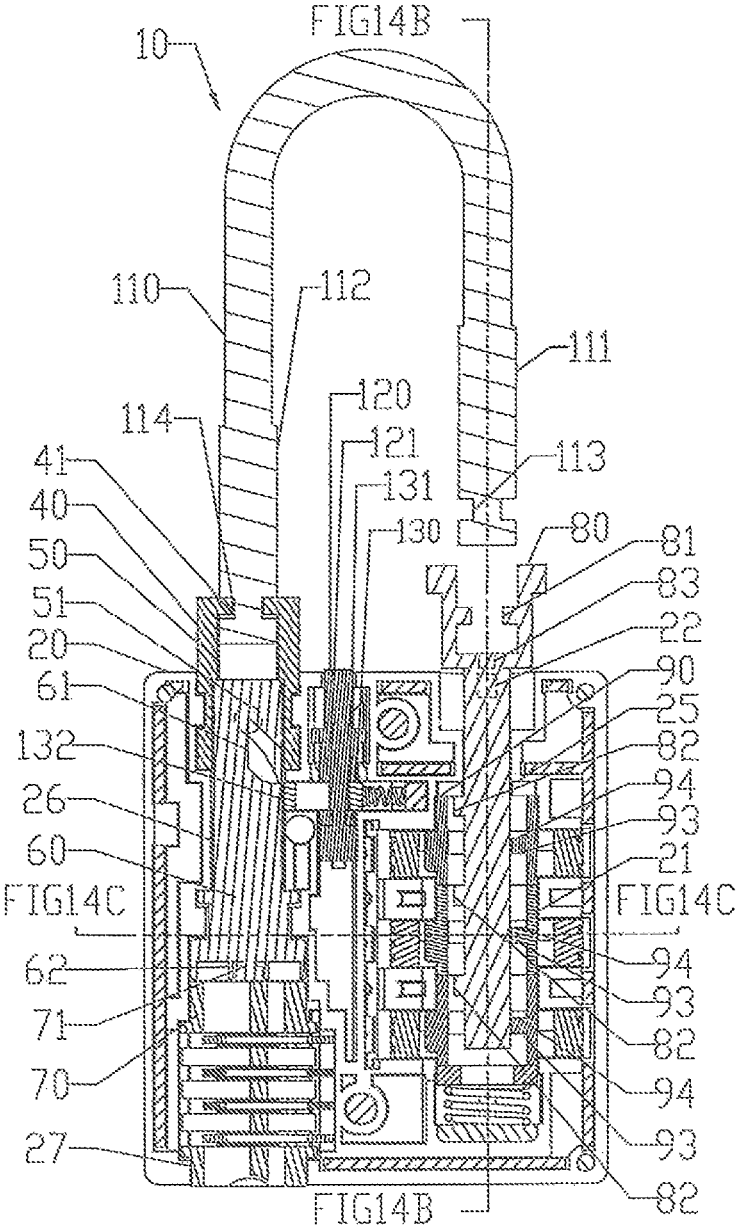
FIG. 14A is a cross-sectional front view of the cable lock when the lock is operated in the unlocked mode, according to an embodiment of the present invention.
Figure 14B:
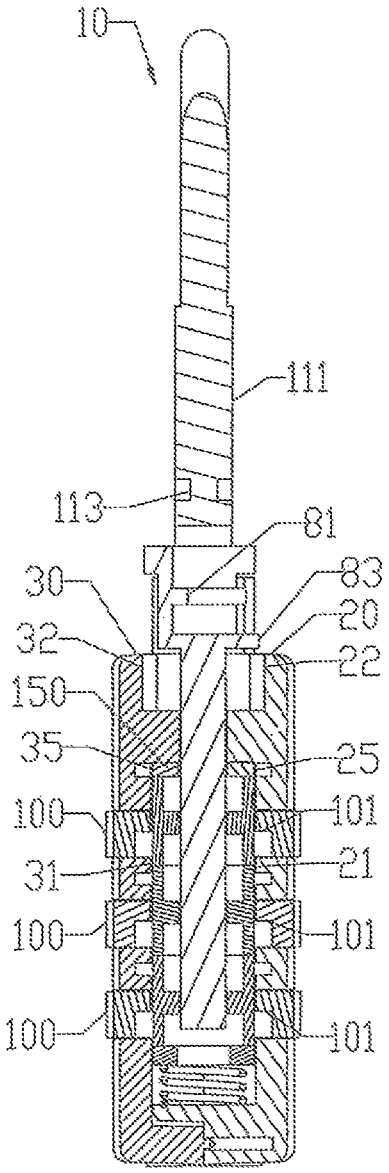
FIG. 14B is a cross-sectional side view of the cable lock of FIG. 14A.
Figure 14C:
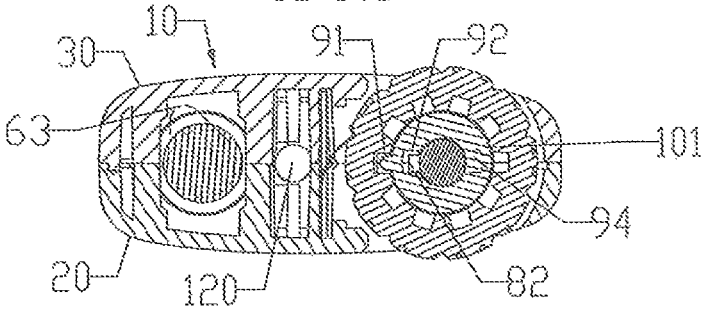
FIG. 14C is a cross-sectional bottom view of the cable lock of FIG. 14A.
Figure 16A:
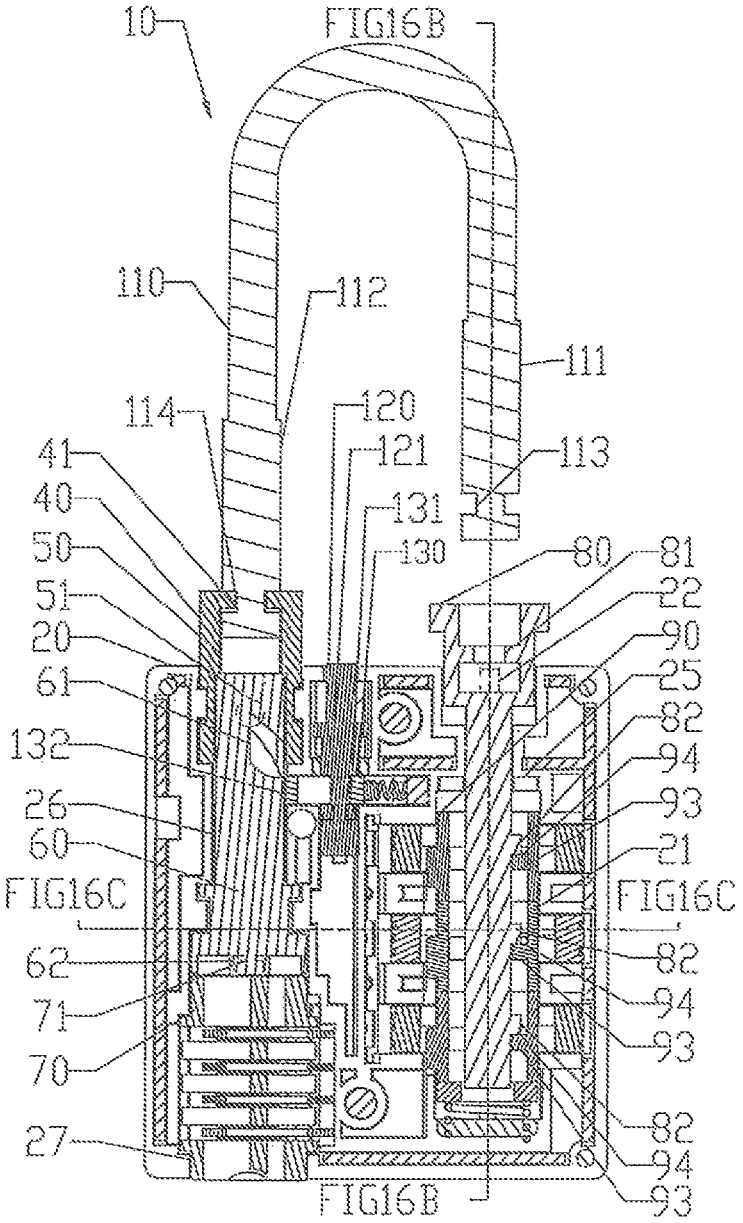
FIG. 16A is a cross-sectional front view of the cable lock when the lock is operated in the unlocked mode and the shaft has been rotated for resetting, according to an embodiment of the present invention.
Figure 16B:
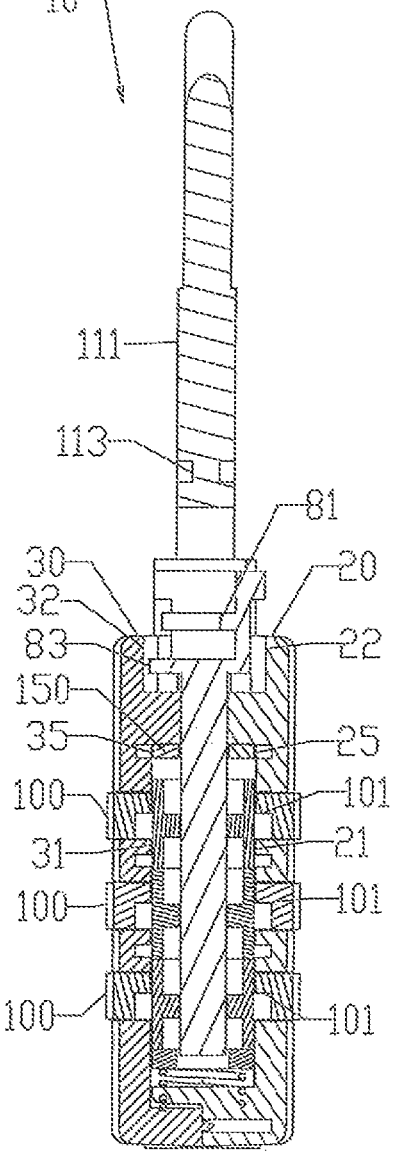
FIG. 16B is a cross-sectional side view of the cable lock of FIG. 16A.
Figure 16C:
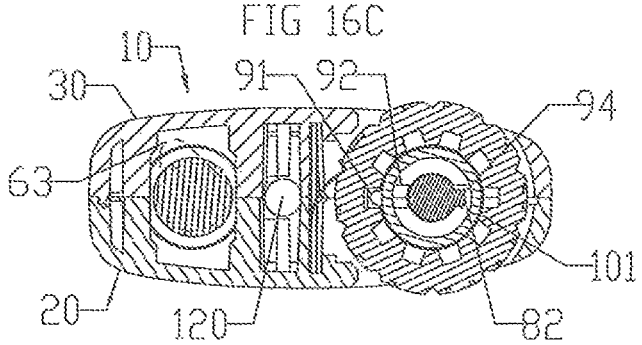
FIG. 16C is a cross-sectional bottom view of the cable lock of FIG. 16A.
Figure 17A:
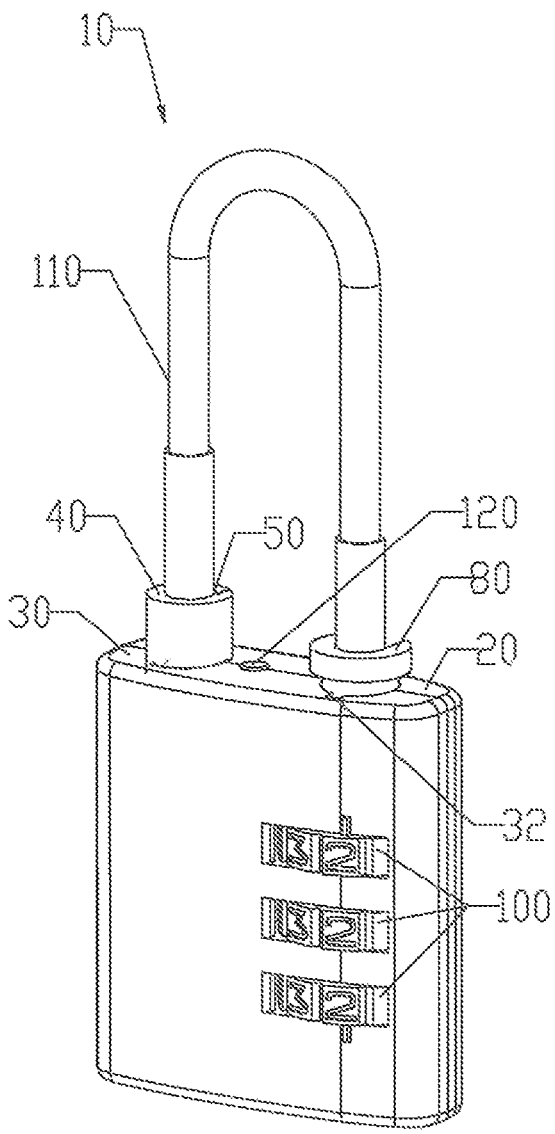
FIG. 17A is a front view of the cable lock when the lock is operated in the locked mode, according to an embodiment of the present invention.
Figure 17B:
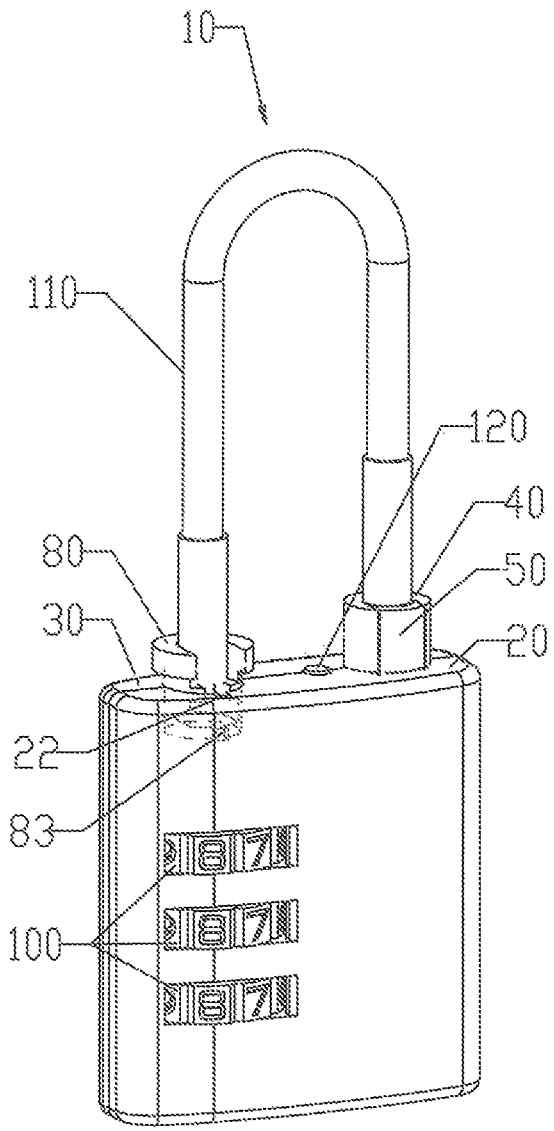
FIG. 17B is a rear view of the cable lock of FIG. 17A.
Figure 18A:
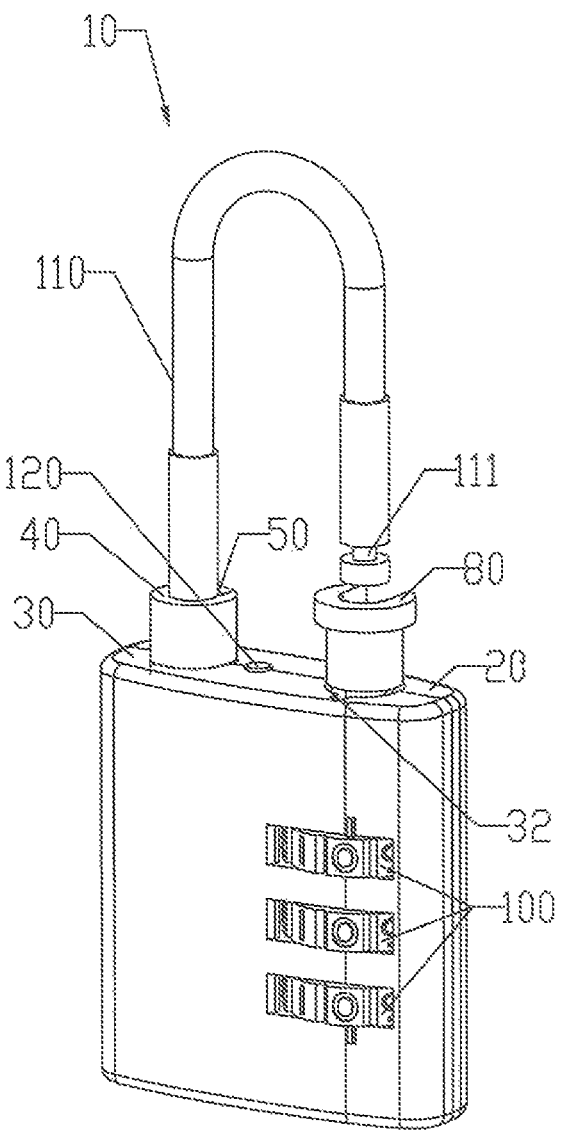
FIG. 18A is a front view of the cable lock when the lock is operated in the unlocked mode, according to an embodiment of the present invention.
Figure 18B:
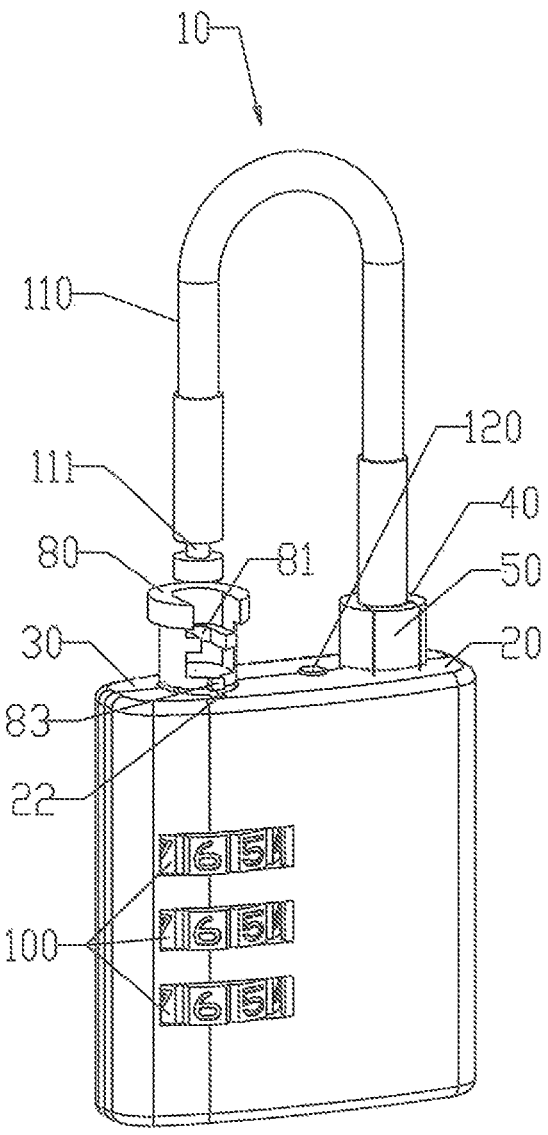
FIG. 18B is a rear view of the cable lock of FIG. 18A.
Figure 19A:
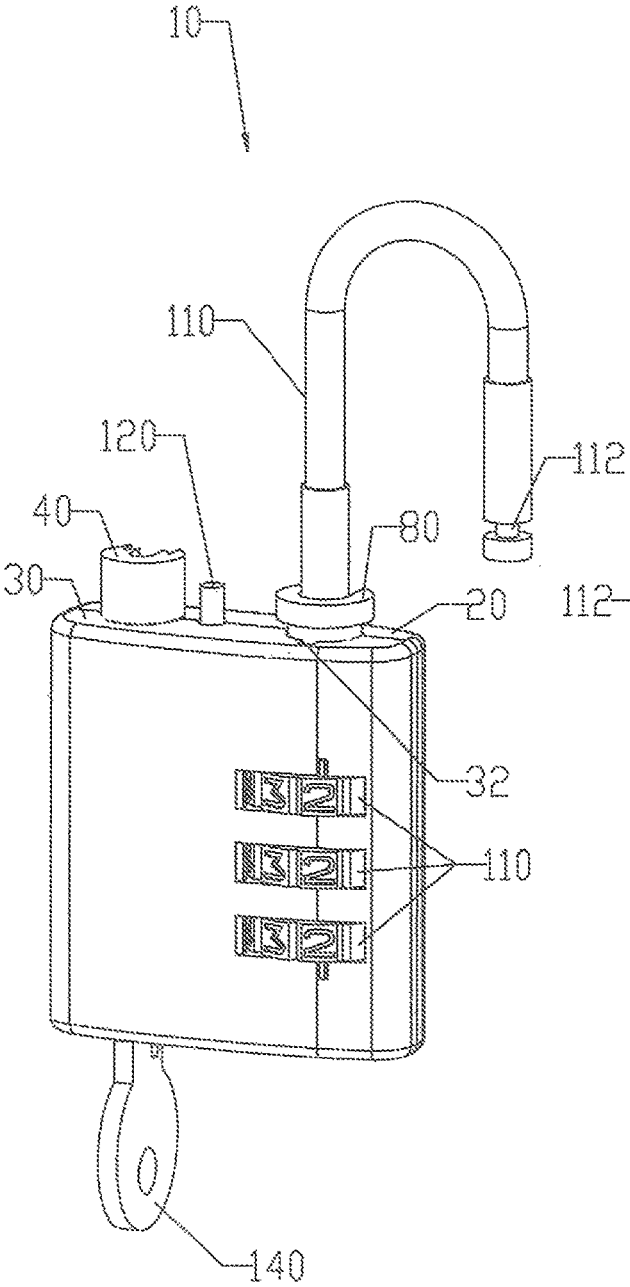
FIG. 19A is a front view of the cable lock when the lock is unlocked with a key, according to an embodiment of the present invention.
Figure 19B:
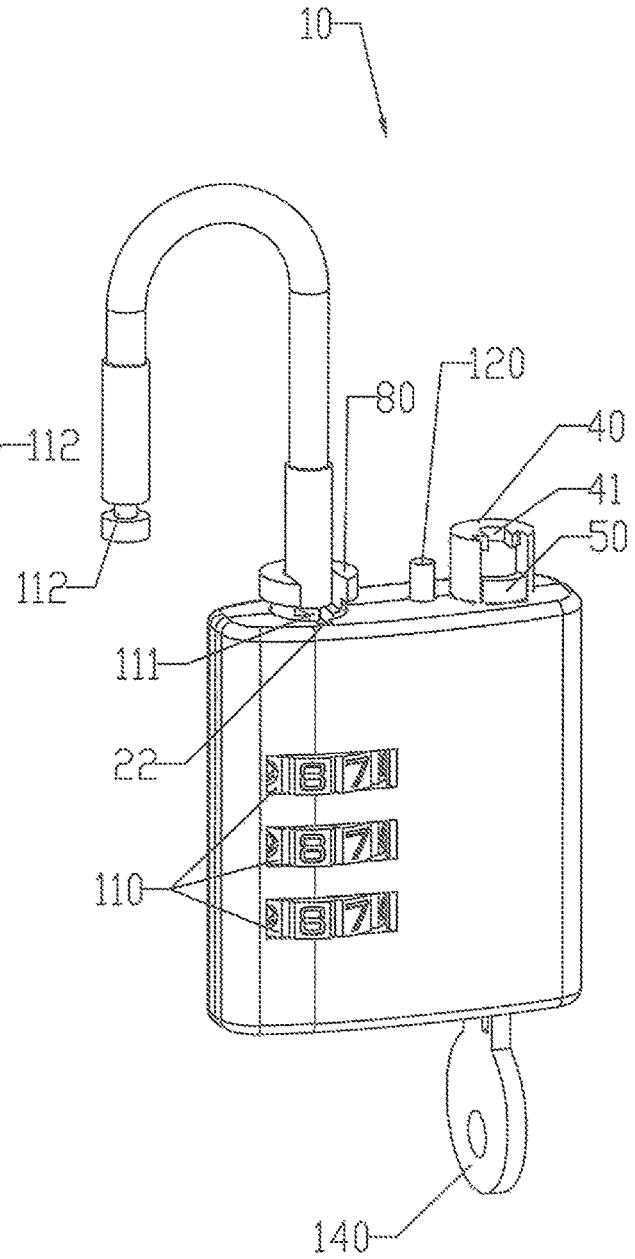
FIG. 19B is a rear view of the cable lock of FIG. 19A.
Figure 20A:
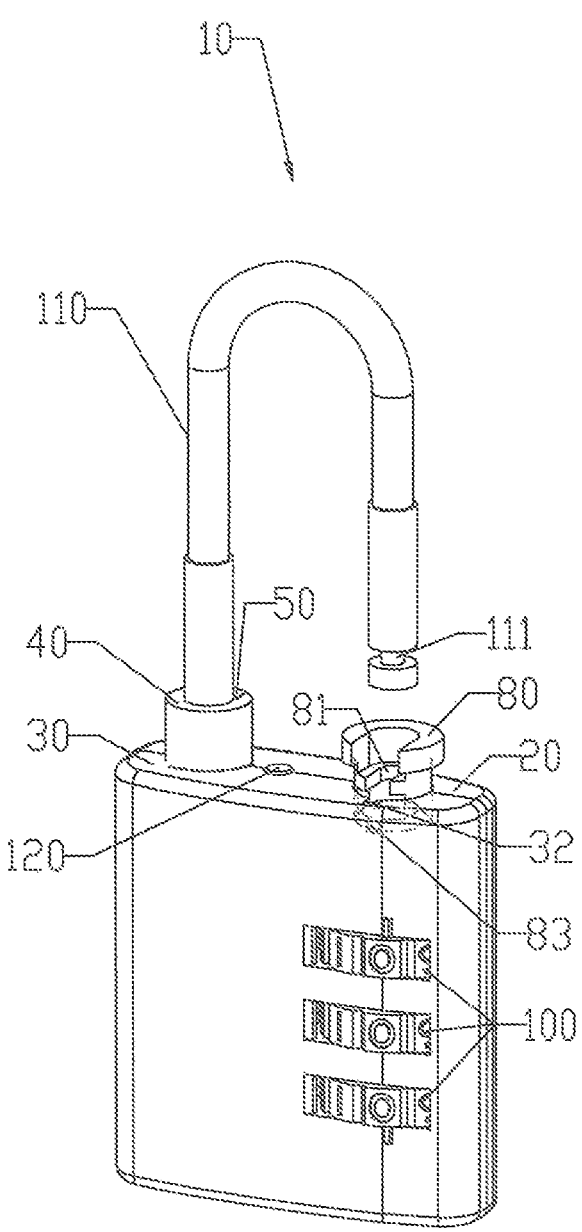
FIG. 20A is a front view of the cable lock when the lock is operated in the unlocked position and the shaft has been rotated for resetting, according to an embodiment of the present invention.
Figure 20B:
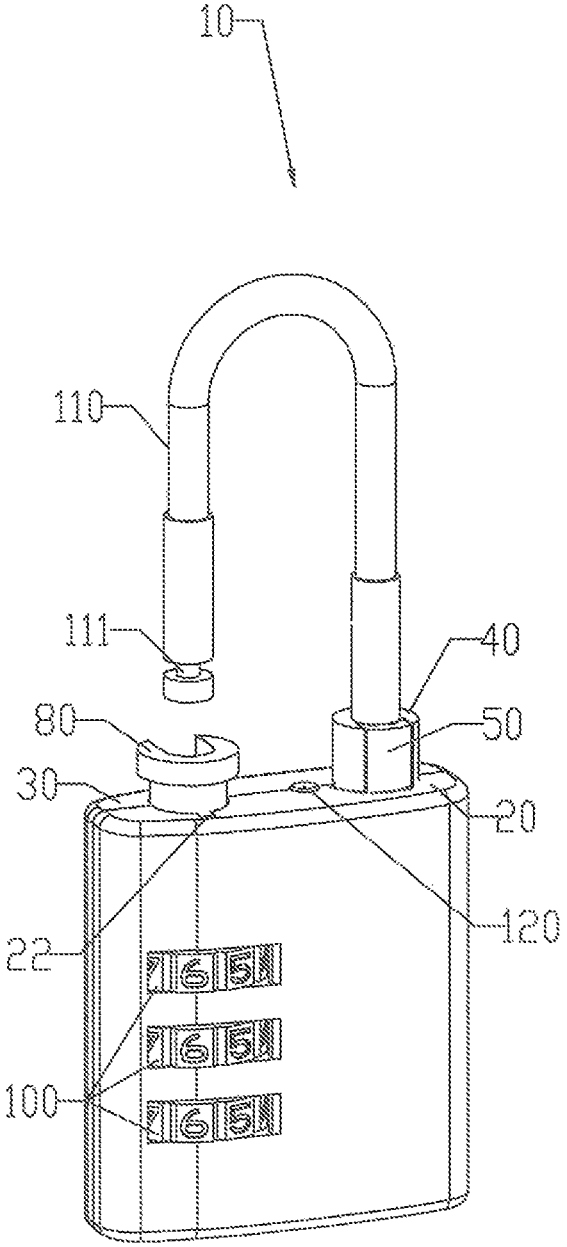
FIG. 20B is a rear view of the cable lock of FIG. 20A.

FIGS. 1A-1C are cross sectional views of the cable lock 10 when the lock is operated in the locked mode, according to an embodiment of the present invention. FIGS. 2 and 3 illustrate two halves of the lock body 20/30, the lock body 20/30 having a top end 28/38 and a bottom end 29/39. FIG. 4 illustrates a fixed cam 40 having a fixed cam slot 41. FIG. 5 illustrates a blocking plate 50 having a pin 51. FIG. 6 illustrates a rotatable cam 60 having a cam slot 61, a cam finger 63 and two cam holes 62 on the bottom end of the rotatable cam 60. The cam 60 can be rotated between a first cam position and a second cam position. FIG. 7 illustrates a cylinder 70 having two cylinder protrusions 71 arranged to engage with the cam holes 62 of the rotatable cam 60. FIG. 8 illustrates a shaft 80 having a top portion 85 with a shaft slot 81 and a reset pointer 83, and a shaft body 86 having a plurality of shaft protrusions 82. FIG. 9A illustrates the bottom view of a clutch 90 having an extended fin 91 extending from the outer surface of the clutch 90 and an inner ring 93 extended inward from the inner surface of the clutch 90. The inner ring 93 has an opening gap 92 made therein. FIG. 9B is the top view of the clutch 90, showing a reset edge 94 made on the upper side of the inner ring 93. The reset edge 94 is spaced from the opening gap 92. FIG. 10 shows a dial 100 having a plurality of teeth 101 dimensioned to receive the extended fin 91 of a clutch 90. FIG. 11 shows a cable 110 comprising a first cable end 111 having a first end neck 113 and a second cable end 112 having a second end neck 114. FIG. 12 shows an indicator 120 having an indicator top 122 and an indicator body 123 with an indicator neck 121. FIG. 13 shows a fork plate 130 comprising fork opening 134 having a fork groove 131 in communication with the fork opening 134. The fork plate 130 also has a fork wall 132 and a fork pin 133 for mounting a spring. When the lock 10 is operated in the locked mode (FIG. 1A), in the unlocked mode unlocked by the combination mechanism (FIG. 14A) or in the reset mode (FIG. 16A), the indicator neck 121 is engaged with the fork groove 131 of the fork plate 130, and the cam finger 63 of the rotatable cam 60 is spaced from the fork wall 132. The fork plate 130 is urged by a spring mounted on the fork pine 133 to move toward the rotatable cam 60, keeping the entire indicator 120 within the lock body 20/30.

As seen in FIGS. 1A-1C, the cable lock 10 has a lock body 20/30 with a plurality of dial slots 24/34 dimensioned to receive a plurality of dials 100, a body channel 21/31 dimensioned to receive a stack of clutches 90 and the shaft 80. The shaft 80 has a plurality of the shaft protrusions 82, each associated with one of the clutches 90. Each of the clutches 90 is associated with a different one of the dials 100. The cable lock 10 has a fixed cam 40 fixedly mounted near the top end of the lock body 20/30 and a blocking plate 50 slideably engaged with the fixed cam 40, the block plate 50 can be caused to move between a first plate position and a second plate position.

When the lock is operated in the locked mode, the first end neck 113 of the first cable end 111 is engaged with the shaft slot 81 in the top portion 85 of the shaft 50, and the second end neck 114 of the second cable end 112 is engaged with the fixed cam slot 41 of the fixed cam 40. The blocking plate 50 is located at the first plate position, the second cable end 112 of the cable 110 is enclosed between the blocking plate 50 and the fixed cam 40. At the same time, each of the shaft protrusions 82 is located below the lower surface of the inner ring 93 of the associated clutch 90, and at least one of the dials 100 is not positioned in the lock-open position. The opening gap 92 of at least one of the clutches 90 is misaligned with the associated shaft protrusion 82 of the shaft body 86, preventing the shaft 80 from moving upward relative to the lock body 20/30. As such, part of the top portion 85 of the shaft 80 is hidden below the top end of the block body 20/30. The first end neck 113 cannot be removed from the shaft slot 81. In this manner, the cable 110 is secured by the combination mechanism. Furthermore, the reset pointer 83 of the shaft 80 is engaged in the restricting track 22 of the lock body 20/30, preventing the shaft 80 from rotation relative to the lock body 20/30.

As seen in FIG. 1A, the lock 10 also has a rotatable cam 60 located near the top end of the lock body 20/30. The rotatable cam 60 has a partial-spiral cam slot 61 dimensioned to receive the pin 51 of the blocking plate 50. The lock 10 also has a cylinder 70 located near the bottom end of the lock body 20/30 with the cylinder protrusions 71 engaged with the cam holes 62 of the rotatable cam 60. As the cylinder 70 cannot rotate relative to the lock body 20/30 without a key, the rotatable cam 60 is at the first cam position and cannot rotate relative to the lock body 20/30. As such, the blocking plate 50 remains at the first plate position to prevent the second end neck 114 of the second cable end 112 from disengaging from the fixed cam slot 41 of the fixed cam 40.

Unlocked by Combination Code (FIGS. 14A-14C, 18A-18B)

When the lock 10 is not in a reset mode, the extended fin 91 of each of the clutches 90 is engaged with one of the teeth 101 of the associated dial 100, and the clutches 90 are rotatable together with the dials 100. To unlock the lock 10 by the combination mechanism, the dials 100 must be turned to match the combination code so that each of the shaft protrusions 82 is aligned with the opening gap 92 of the associated clutches 90. The shaft 90 can then be moved upward when the first cable end 111 of the cable 110 is pulled upward. As such, the shaft slot 81 of the shaft top portion 85 is located above the top end of the lock body 20/30, allowing the first end neck 113 of the first cable end 111 to be removed from the shaft slot 81. The lock 10 has a stop plate 150 located in the groove edge 25/35 of the lock body 20/30 to limit the upward movement of the shaft 80 by blocking the topmost shaft protrusion 82.

Unlocked by Key (FIGS. 15A-15C, 19A-19B)

Figure 15A:
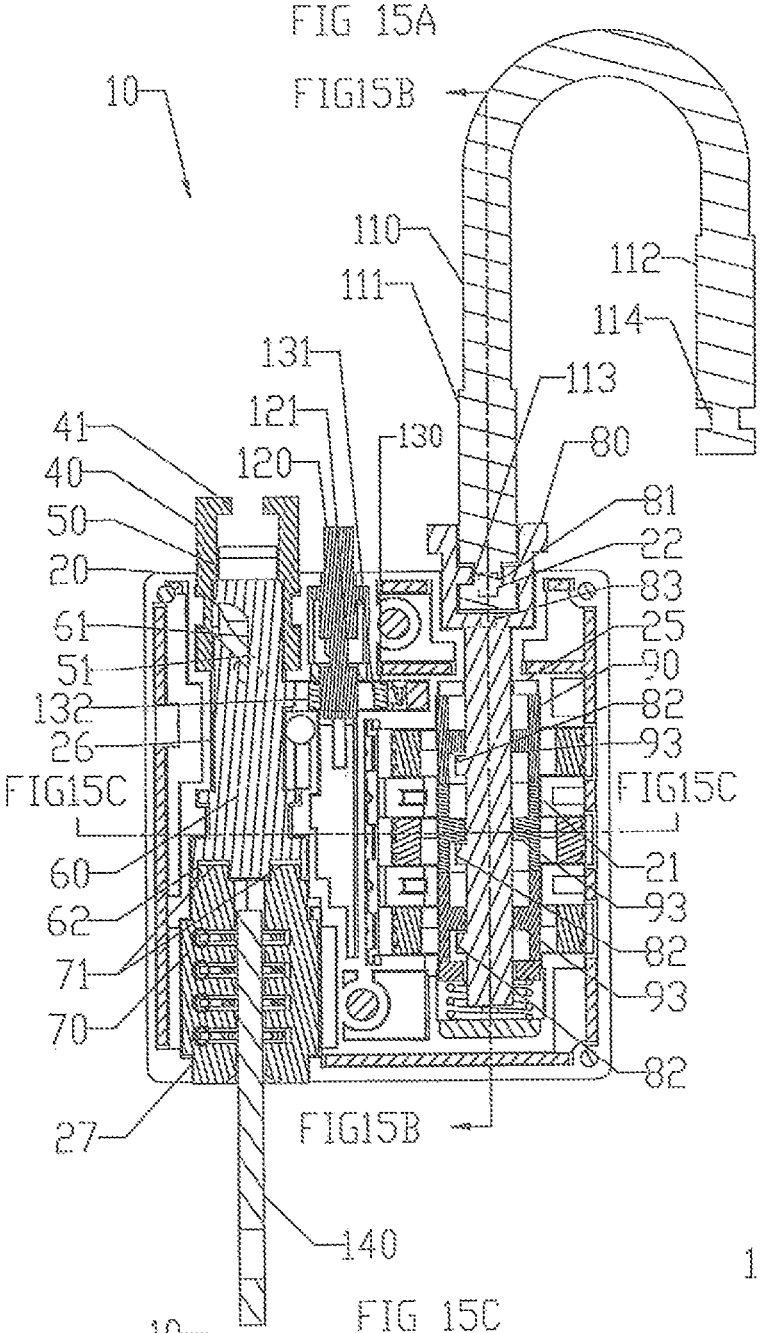
FIG. 15A is a cross-sectional front view of the cable lock when the lock is unlocked with a key, according to an embodiment of the present invention.
Figure 15B:
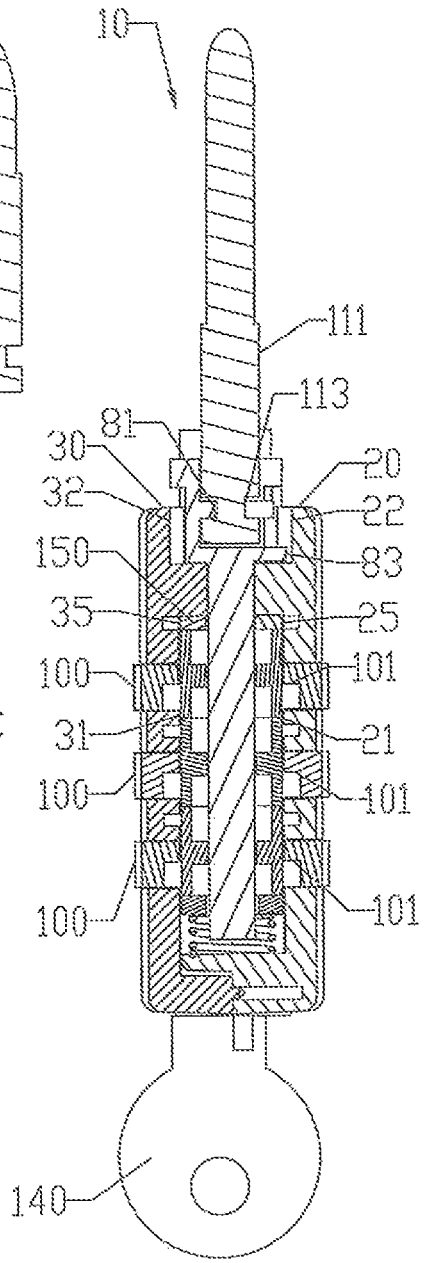
FIG. 15B is a cross-sectional side view of the cable lock of FIG. 15A.
Figure 15C:
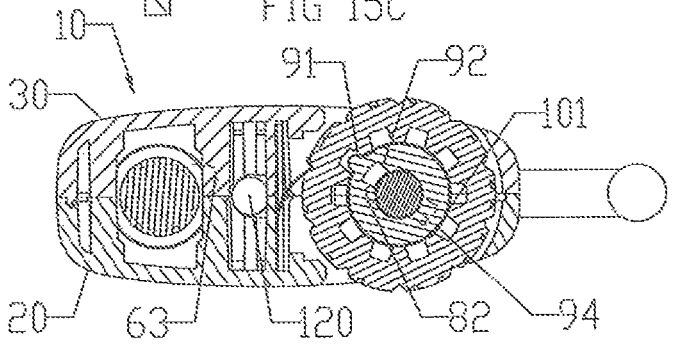
FIG. 15C is a cross-sectional bottom view of the cable lock of FIG. 15A.

As seen in FIG. 15A, the cylinder protrusions 71 are engaged with the cam holes 62 of the rotatable cam 60, and the pin 51 of the blocking plate 50 is slideably engaged with the cam slot 61 of the rotatable cam 60. When a key 140 is inserted into the cylinder 70, the wafer in the cylinder 70 retracts into the cylinder to allow the cylinder 70 to turn. As the cylinder 70 turns, the rotatable cam 60 also rotates relative to the lock body 20/30 from the first cam position to the second cam position. With the pin 51 of the blocking plate 50 being engaged with the partial-spiral cam slot 61, the rotation of the rotatable cam 60 drags the blocking plate 50 downward, from the first plate position to the second plate position. At the second plate position, the blocking plate 50 exposes the fixed cam slot 41 of the fixed cam 40. The second end neck 114 of the second cable end 112 can be disengaged from the fixed cam slot 41. However, the first end neck 113 of the first cable end 111 remains engaged with the shaft slot 81 of the shaft 80. The reset pointer 83 also remains engaged with the restricting track 22 of the lock body 20/30, preventing the shaft 80 from rotation relative to the lock body 20/30.

As the rotatable cam 60 is caused to rotate from the first cam position to the second cam position, the cam finger 63 of the rotatable cam 60 comes into contact with the fork wall 132 of fork plate 130, pushing the fork plate 130 away from the rotatable cam 60, releasing the indicator neck 121 of indicator 120 from of the fork groove 131. At the same time, the indicator 120 is pushed upward by a spring below (not shown), causing the indicator top 122 to move out of the lock body 20/30 (see FIG. 15A). The pop-up of the indicator 120 serves as a reminder that the lock has been unlocked by a key.

Reset Mode (FIGS. 16A-16C, 20A-20B)

When the lock 10 is unlocked by the combination mechanism and the shaft 80 is pulled upward, the reset pointer 83 is disengaged from the restricting track 22 of the lock body 20/30. The shaft 80 can be turned relative to the lock body 20/30. When the reset pointer 83 is aligned with the reset track 32 on the lock body 20/30, the shaft 80 can be pushed downward to cause each of the shaft protrusions 82 to engage with the reset edge 94 of the associated clutch 90. The reset track 32 prevents the shaft 80 from rotation relative to the lock body 20/30. The engagement between the shaft protrusions 82 with the reset edges 94 of the clutches 90 further prevents the clutches 90 from rotation relative to the lock body 20/30 during the reset mode.

To reset the lock 10, the clutches 90 must be pushed further downward by the shaft protrusions 82 of the shaft 80 until the extended fins 91 of the clutches 90 are disengaged from the teeth 101 of the dials 100. The user can then rotate the dials 100 without the clutches 90 to set a new combination code.

After resetting, the user must pull the shaft 90 upward until the reset pointer 83 of shaft 90 is disengaged from the reset track 32 of the lock body 20/30. The user can relock the lock 10 with the new combination code.

Figure 21:
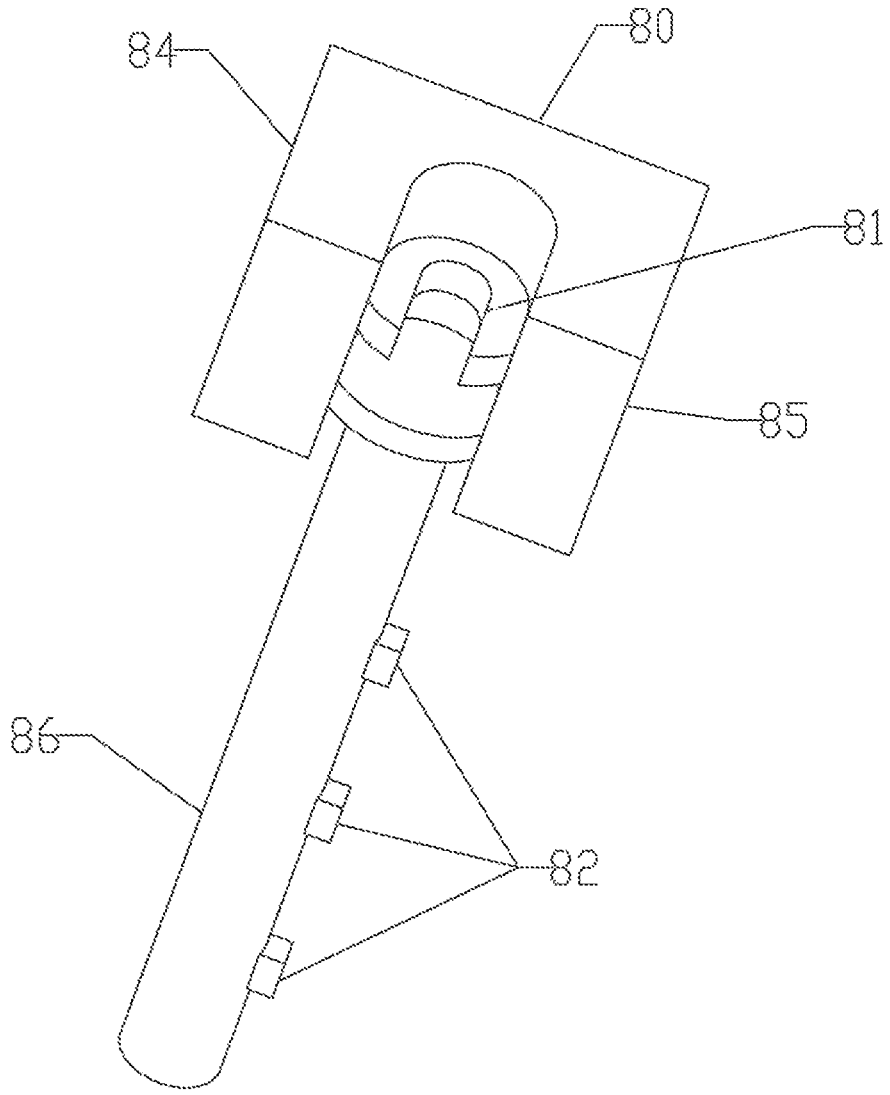
FIG. 21 illustrates a shaft, according to another embodiment of the present invention.
Figure 22:
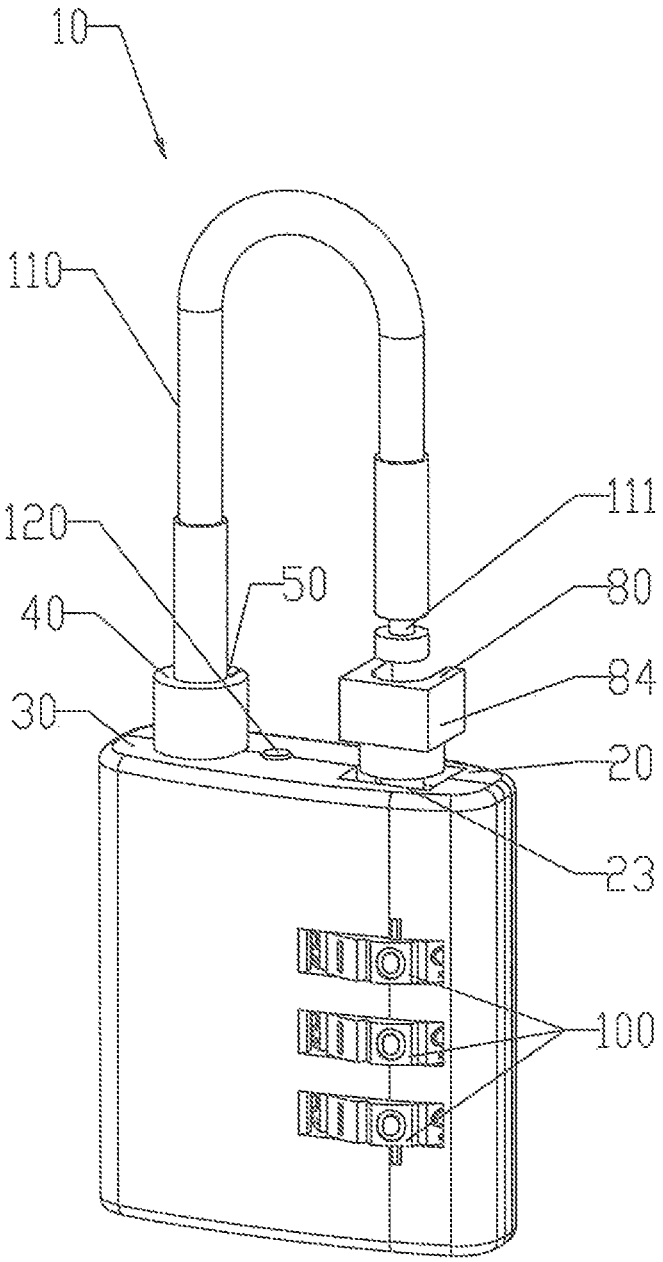
FIG. 22 shows a front view of the cable lock when the lock is unlocked by a combination code, according to another embodiment of the present invention.

FIGS. 21 and 22

As shown in FIG. 8, the shaft 80 has a top portion 85 with a reset pointer 83. As indicated in FIGS. 2 and 3, the lock body 20/30 has a circular hole dimensioned to received part of the top portion 85 of shaft 80. The lock body half 20 has a restricting track 22 and the lock body half 30 has a reset track 32. As shown in FIGS. 1A, 1B, 8, 14A, 14B, 15A, 15B, 16A, 16B and 17A-20B, the engagement between the restricting track 22 of the lock body 20/30 and the reset pointer 83 of the top portion 85 of shaft 80 prevents the shaft 80 from rotation relative to the lock body 20/30 when the lock is locked or is unlocked by the key overriding mechanism. In the reset mode, the engagement between the rest pointer 83 and the reset track 32 on lock body 20/30 also prevents the shaft 80 from rotation relative to the lock body 20/30.

In a different embodiment of the present invention, a rectangular top 84 of the top portion 85 of shaft 80 is used to replace the reset pointer 83, and the lock body 20/30 has a rectangular opening 23 at the upper end of the lock body 20/30 for to replace the circular opening having a restricting track 22 and the reset track 32. As shown in FIG. 21, the rectangular top 84 has a cable slot 87 to allow the first end neck 113 of the first cable end 111 to engage with the shaft slot 81. The rectangular opening 23 on the lock body 20/30 is dimensioned to receive the rectangular top 84.

When the lock 10 is operated in the locked mode or is unlocked by the key overriding mechanism, at least part of the rectangular top 84 is located inside the rectangular opening 23 to prevent the first end neck 113 of the first cable end 111 from disengaging from the shaft slot 81. When the lock is unlocked by the combination mechanism, the rectangular top 84 is moved out of the rectangular opening 23 of the lock body 20/30 as shown in FIG. 22. The first cable end 111 of the cable 110 can be released from the lock body 20/30. In the reset mode, the shaft 80 is rotated 180 degrees relative to the lock body 20/30 to align the rectangular top 84 with the rectangular opening 23 so that the shaft 80 can be pushed downward to release the extended fins 91 of the clutches 90 from the teeth 101 of the dials 100.

It is understood that while the rectangular top 84 can be fitted into the rectangular opening 23 in two directions: one direction to lock and the other direction to reset the lock 10, the top of the shaft 80 and the opening on the lock body 20/30 can be of different shapes than rectangular. The shaft top and lock body opening can be elliptical to achieve the same function. Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A lock operable in a locked mode and in an unlocked mode, comprising:

a lock body having a first end and an opposing end;

a fixed cam having a fixed cam slot, the fixed cam located near the first end of the lock body;

a shaft comprising a shaft body and a top portion adjacent to the first end of the lock body, the top portion having a shaft slot;

a first unlocking mechanism operatively coupled to the shaft;

a second unlocking mechanism operatively coupled to the fixed cam; and a cable comprising a first cable end and a second cable end, the first cable end having a first end neck removably engaged with the shaft slot, the second cable end having a second end neck removably engaged with the fixed cam slot of the fixed cam, wherein the first unlocking mechanism comprises a stack of clutches and a plurality of dials, each dial associated with a different one of the clutches, and wherein the shaft further comprises a plurality of shaft protrusions on the shaft body, each shaft protrusion associated with one of the clutches, and wherein the second unlocking mechanism comprises a blocking plate positioned in relationship to the fixed cam, the blocking plate locatable at a first plate position to prevent the second end neck from disengaging from the fixed cam slot, and a second plate position to allow the second end neck to remove from the fixed cam slot;

wherein the lock body comprises:

a plurality of dial slots dimensioned to receive the dials, and a body channel dimensioned to receive the stack of clutches and the shaft, and wherein each of the clutches has an extended fin on an outer surface of the clutch and an inner ring extended inward from an inner surface of the clutch, the inner ring having an opening gap made thereon, the opening gap dimensioned to receive the associated shaft protrusion, the inner ring having a lower surface, and an upper surface facing the first end of the lock body, and wherein each of the dials has a plurality of teeth dimensioned to receive the extended fin of the associated clutch, wherein when the lock is operated in the locked mode, the blocking plate is located at the first plate position; and each of the shaft protrusions is located below the lower surface of the inner ring of the associated clutch, and the opening gap of at least one of the clutches is misaligned with the associated shaft protrusion, preventing the shaft from moving upward relative to the lock body, and when the lock is caused to change from the locked mode to the unlocked mode by the first unlocking mechanism, the opening gap of each of the clutches is aligned with the associated shaft protrusion, allowing the shaft to move upward to release the first end neck of the first cable end from the lock body, and when the lock is caused to change from the locked mode to the unlocked mode by the second unlocking mechanism, the block plate is caused to move from the first plate position to the second plate position.

2. The lock according to claim 1, wherein the shaft further comprises a reset pointer, and the lock body further comprises a restricting track near the first end of the lock body, the restricting track dimensioned to receive the reset pointer, and wherein when the lock is operated in the locked mode, the reset pointer of the shaft is engaged with the restricting track, preventing the shaft from rotation relative to lock body, and when the lock is caused to change from the locked mode to the unlocked mode by the first unlocking mechanism, the shaft is caused to move upward to disengage the reset pointer from the restricting track, allowing the shaft to rotate relative to the lock body to reset the lock.

3. The lock according to claim 2, wherein the upper surface of the inner ring of each of the clutches comprises a reset edge spaced from the opening gap in the inner ring, and the lock body further comprises a reset track near the first end of the lock body, spaced from the restricting track, wherein when the shaft is rotated so that the reset pointer is aligned with the reset track, the shaft can be pushed downward until each the shaft protrusions is located in the reset edge of the associated clutch to prevent the clutch from rotation relative to the lock body.

4. The lock according to claim 3, wherein when each of the shaft protrusions is located in the reset edge of the associated clutch and the shaft is caused to move further downward to disengage the extended fins of the clutches from the teeth of the dials, the dials can be rotated without the clutches to set a new combination code.

5. The lock according to claim 1, wherein the blocking plate comprises a pin, the lock further comprising:

a rotatable cam comprising a semi-spiral slot dimensioned to receive the pin of the blocking plate, and wherein when the rotatable cam is caused to rotate relative to the lock body from a first cam position to a second cam position, the blocking plate is also caused to move from the first plate position to the second plate position.

6. The lock according to claim 5, further comprising a cylinder located near the second end of the lock body, the cylinder comprising a key slot arranged to receive a key to open the lock by turning the cylinder relative to the lock body, wherein the cylinder comprises one or more cylinder protrusions, and the rotatable cam comprises one or more cam holes dimensioned to receive said one or more cylinder protrusions, and when the cylinder turns, the rotatable cam is caused to rotate relative to the lock body from the first cam position to the second cam position.

7. The lock according to claim 6, further comprising an indicator located near the first end of the lock body, and a fork plate having a fork wall adjacent to the rotatable cam, the fork plate locatable at a first fork position and a second fork position, the indicator having an indicator top and an indicator body with an indicator neck, the fork plate further comprising a fork opening dimensioned to receive the indicator body, and a fork groove extended from the fork opening dimensioned to receive the indicator neck when the fork plate is located at the first fork position, wherein the rotatable cam further comprises a cam finger, and wherein when the rotatable cam is located at the first cam position, the cam finger is spaced from the fork wall and the fork plate is located at the first fork position, and when the rotatable cam is located at the second cam position, the cam finger is arranged to push the fork wall away from the rotatable cam to release the indicator neck from the fork groove, allowing the indicator top to move out of the first end of the lock body.

8. The lock according to claim 1, wherein the top portion of the shaft comprises a rectangular part, and the lock body further comprises a top opening dimensioned to receive the rectangular part, and wherein when the lock is operated in the locked mode, the rectangular part of the shaft is engaged with the top opening of the lock body, preventing the shaft from rotation relative to lock body, and when the lock is caused to change from the locked mode to the unlocked mode k the first unlocking mechanism, the shaft is caused to move upward to disengage the rectangular part from the top opening of the top body, allowing the shaft to rotate relative to the lock body to reset the lock.

9. The lock according to claim 8, wherein the upper surface of the inner ring of each of the clutches comprises a reset edge spaced from the opening gap in the inner ring, and when the shaft is caused to rotate and the rectangular part of the shaft is again receivable in the top opening of the lock body, the shaft can be pushed downward until the shaft protrusion is located in the reset edge of the associated clutch, the shaft protrusions configured to prevent the clutch from rotation relative to the lock body.

10. The lock according to claim 9, wherein when each of the shaft protrusions is located in the reset edge of the associated clutch, and the shaft is caused to move further downward to disengage the extended fins of the clutches from the teeth of the dials, the dials can be rotated without the clutches to set a new combination code.

* * * * *